US006223551B1

(12) United States Patent
Mitchell

(10) Patent No.: US 6,223,551 B1
(45) Date of Patent: May 1, 2001

(54) PORTABLE FLEXIBLE CONTAINER FOR KEEPING ARTICLES COLD

(75) Inventor: Barry Trevor Mitchell, Mount Gravatt (AU)

(73) Assignee: Instar Pty. Ltd. (AU)

( * ) Notice: Subject to any disclaimer, the term of this patent is extended or adjusted under 35 U.S.C. 154(b) by 0 days.

(21) Appl. No.: 09/117,442

(22) PCT Filed: Jan. 29, 1997

(86) PCT No.: PCT/AU97/00047

§ 371 Date: Apr. 22, 1999

§ 102(e) Date: Apr. 22, 1999

(87) PCT Pub. No.: WO97/28064

PCT Pub. Date: Aug. 7, 1997

(30) Foreign Application Priority Data

| | | |
|---|---|---|
| Jan. 29, 1996 | (AU) | PN7763 |
| Apr. 10, 1996 | (AU) | PN9161 |
| Nov. 22, 1996 | (AU) | PO3773 |

(51) Int. Cl.[7] ..... F25D 3/08

(52) U.S. Cl. ..... 62/371; 62/457.2; 62/530

(58) Field of Search ..... 62/457.1, 457.2, 62/530, 371; 126/204; 165/46

(56) References Cited

U.S. PATENT DOCUMENTS

| | | | | |
|---|---|---|---|---|
| 1,696,138 | * | 12/1928 | Day et al. | 62/530 |
| 2,606,005 | * | 8/1952 | Poux | 165/46 |
| 2,781,643 | | 2/1957 | Fairweather . | |
| 3,066,847 | * | 12/1962 | Fortune | 62/530 |
| 3,429,138 | * | 2/1969 | Goldmerstein | 165/46 |
| 4,311,022 | | 1/1982 | Hall | 62/530 |
| 4,324,111 | | 4/1982 | Edwards | 62/530 |
| 4,530,220 | * | 7/1985 | Nambu et al. | 62/530 |
| 4,846,176 | * | 7/1989 | Golden | 165/46 |
| 4,958,635 | * | 9/1990 | Roberts | 62/530 |
| 5,237,838 | * | 8/1993 | Merritt-Munson | 62/530 |
| 5,361,603 | * | 11/1994 | Merritt-Munson | 62/530 |
| 5,490,396 | * | 2/1996 | Morris | 62/530 |
| 5,728,146 | * | 3/1998 | Burkett et al. | 165/46 |
| 5,840,080 | * | 11/1998 | Der Ovanesian | 62/530 |
| 5,865,314 | * | 2/1999 | Jacober | 62/457.2 |
| 5,887,437 | * | 3/1999 | Maxim | 62/530 |

FOREIGN PATENT DOCUMENTS

| | | |
|---|---|---|
| 56 527/80 | 5/1981 | (AU) . |
| 41388/85 | 10/1985 | (AU) . |
| 46901/85 | 3/1986 | (AU) . |
| 1111645 | 3/1956 | (FR) . |
| 2 635 580 | 2/1990 | (FR) . |
| 1185811 | 3/1970 | (GB) . |
| 2 014 713 | 8/1979 | (GB) . |
| 3275477 | 12/1991 | (JP) . |
| 7223677 | 8/1995 | (JP) . |

* cited by examiner

*Primary Examiner*—William E. Tapolcai
(74) *Attorney, Agent, or Firm*—Akerman Senterfitt

(57) ABSTRACT

An envelope for keeping susceptible materials such as drugs within an acceptable temperature for durations to allow for transport of the drugs to recipients the cold keeping envelope having an outer insulating envelope and an inner envelope or envelope like shape having liquid or liquid like material to be frozen held within a plurality of separate cells forming the inner envelope such that when the liquid or liquid like material is frozen solid, the inner envelope or envelope like shape can still be easily opened caused to open by relative rotation of separate cell to allow for insertion of articles therein. There are further described constructions including an outer envelope of bubble pack with a metallised reflective surface, joining of inner and outer envelope parts, double thicknesses of bubble pack material, use of frozen cells on one side only of the envelope shape, and shapes and relative location of cells to facilitate bending of the frozen materials.

12 Claims, 8 Drawing Sheets

PORTABLE FLEXIBLE CONTAINER FOR KEEPING ARTICLES COLD

This invention relates to a cold envelope having a purpose of holding articles cold that need to be kept cold during a modest transport period of time.

Articles such as medicines, biological materials and the like are the type of materials that need to be transported typically from a central storage locality to a retail sales outlet.

The challenge then has been to be able to provide a package which can be as small as possible and therefor as economic as possible in terms of the material needed to manufacture the holder while at the same time the package should provide an arrangement that can be used over a repeated number of times, which will take up a minimum amount of space, will reliably hold any articles therein within a selected temperature range over a selected period and will ensure that when articles are within the arrangement, they will be appropriately subjected to appropriate cooling.

Reference throughout this specification is made to an envelope or envelope like shape which is to be taken as referring to an article with two sheets providing two sides which are joined directly together at their side edges and one end.

An object of this invention is to propose a cold pack for articles that need to be kept cold during transport which answers at least one of the above difficulties or provides the public with a useful alternative.

According to this invention, there is proposed a cold keeping envelope for articles that need to be kept cold during transport comprising an outer insulating envelope and an inner envelope or envelope like shape having liquid or liquid like material to be frozen held within a plurality of separate cells forming the inner envelope such that when the liquid or liquid like material is frozen solid, the inner envelope can be caused to open by relative rotation of adjacent frozen cells to allow for insertion of articles therein.

This, in preference, is directed to an envelope as a shape and proposes two envelopes or envelope and envelope like shape one encompassing the other in which the inner envelope or envelope like shape holds the material that will keep the inner articles cold. The conventional problem here though is if one uses an envelope shape, when liquid held within an inner envelope shape is frozen, this will be frozen rigid and one simply will not be able to easily open the envelope shape to get articles inside.

The answer has been to divide the frozen materials into separate cells which extend into an envelope shape but such that the connections between each cell are not going to be made rigid by freezing at least at temperatures at which the liquid or liquid like material will be frozen solid so that the cells will pivot one with respect to another about their mutual joint areas.

The simple result is that one has an inner frozen part which will be able to be flexed open to allow for an envelope opening so as to be able to put articles therein and even thereafter to be able to close the envelope so that the articles within the envelope shape and especially nested within the inner envelope shape can be assured of being adjacent frozen liquid or liquid-like materials and thus ensure that all parts of the article will be kept at a relatively uniformly cold temperature.

A further problem is to provide an external envelope which can provide most effective insulation without being vulnerable to easy deterioration or being too heavy or too bulky and in this respect, a material that is conventionally used for postage and packing has been found to be ideal namely a sheet or sheets of plastics material in a bubble formation and in further preference, this has sides welded together to form an envelope shape thus forming the outer insulation envelope.

Such material is transparent as conventionally supplied in its normally provided form and there is therefore provided in conjunction with this, in preference, an opaque heat reflective surface on the outer side of the outer envelope material.

With the arrangement described, one of the problems could be that an article when quickly inserted by persons not thoughtfully considering the position could be to insert articles between the inner and outer envelope shapes.

This obviously could be very disadvantageous because it would not necessarily be kept at a preferred temperature and in the case of vulnerable materials and longer transport periods, this could be damaging to the materials and be perhaps dangerous if a user is unaware of the possible deterioration.

This problem has been overcome however by providing in preference that the outer edges of the inner envelope are welded or otherwise adhered to or joined to the outer edges of the outer envelope around the mutual opening area.

It has also been found to be of advantage to ensure that the inner envelope shape when not frozen doesn't bunch up into a smaller area. In preference this is achieved by the bottom of the inner envelope shape being welded to the inner bottom end of the outer envelope.

When reference is made to welding, this assumes that any form of attachment can be used such as adhesion, welding or simply ensuring that some of the parts are extending across in some form of integral way.

In preference there is further value in being able to keep a temperature within the envelope over a sustained period of time within a range of temperatures which are appropriate for particular types of materials.

These types of materials can be pharmaceutical materials and the temperature range that is preferred lies between the range of 2° C. to 8° C.

It has been found that if the envelope has frozen liquid or gel on both sides of the envelope shape, then this can cause the interior to be colder than 2° C. for at least some period of time and in accord with this further preferred improvement then it has been found that there is advantage in providing that the inner envelope shape has cells holding a liquid or liquid like material to be frozen where this is located on one side of the inner envelope shape only.

In preference, with the cells being retained on one side only, there is still separation of the cells by an arrangement so that these can be bent one with respect to the other when the material contained within the cell is frozen solid.

A further preferred feature includes the incorporation of two layers of plastic retaining air in bubble-like formations.

By doubling this material, particularly on the side of the envelope opposite to that in which the material to be frozen or been frozen is held, this reduces the rate of heat gain.

Accordingly, the temperature is kept within the desirable range of 2° C. to 8° C. over a longer period of time.

In preference, the double stack of bubble like formed plastic sheets can also be heat sealed together so as to form parts of lesser thickness which will encourage bending around such locations and by providing these are generally in align with the same patterns of the cells containing the material to be frozen, then when an envelope constructed in accordance with the described features is subjected to freezing and afterwards then opened to receive material to be transported, the opening will follow bending of the surfaces in accordance with the heat welded seams and therefore present a relatively neat box like shape appropriate to receive the material and to be subsequently sealed by a flap in the manner previously described in the other two specifications.

By using a gel pack on one side only of the opening within the envelope this gel pack is then welded at its edges with respect to the remaining materials forming the envelope shape.

As such then there is implicitly formed an inner envelope and the outer elements form an outer envelope even though in this case, it is not clear that there is a separable material specifically forming the other side of an inner envelope which then is integrated into the inner surface of the bubble like formation of the plastic sheets.

Different arrangements of cell shapes, therefore, will give different results and in a further instance, there is provided in preference, a central cell and a plurality of side or perimeter cells adapted to allow for an opening shape in which the side cells will be caused to rotate so that a full opening position has each of the side cells substantially aligned at right angles to the planar orientation of the central cell.

This is assisted by having diagonally divided cells at each corner for each side of the main part having the frozen cells.

In further preference, there can be at times a need to keep the temperature within the inner envelope shape above freezing whereas the frozen cells themselves will be below a freezing temperature.

Such a more desirable arrangement can be achieved by providing a further innermost envelope which of itself provides an insulating effect and in which the goods to be transported are held.

Such an arrangement as a further preferable feature reduces the rate at which heat is drawn from any product within the innermost insulating envelope so that it will implicitly take a lot longer for this to cool down to a below freezing temperature but at the same time, the otherwise frozen gel will be also increasing in temperature because of external exposure so that by the time the innermost envelope has within it a temperature approaching very close to zero, it would be a reasonable expectation that the frozen cells will be appropriately less cold so there will be a balancing of temperature differentials.

It has also been found to be of advantage to ensure that the inner envelope when not frozen doesn't bunch up into a smaller area this being achieved by the bottom of the inner envelope being welded to the inner bottom end of the outer envelope.

When reference is made to welding, this assumes that any form of attachment can be used such as adhesion.

For a better understanding of this invention it will now be described with the assistance of drawings wherein.

Referring in detail to the drawings, the envelope 1 is intended to be of conventional envelope shape which is to say that it has two sides so that when not in use, and whether frozen or not, it will assume a substantially flat or planar shape so that a number of such envelopes can be stacked in storage or in a freezing compartment awaiting use without taking up substantial volume.

If an envelope were to have a conventional slab of liquid to be frozen inside which was then frozen, because it is essentially of a flat shape, it would be impracticable to open the envelope up to insert articles for transport purposes inside the envelope when it is frozen.

Figure 2:
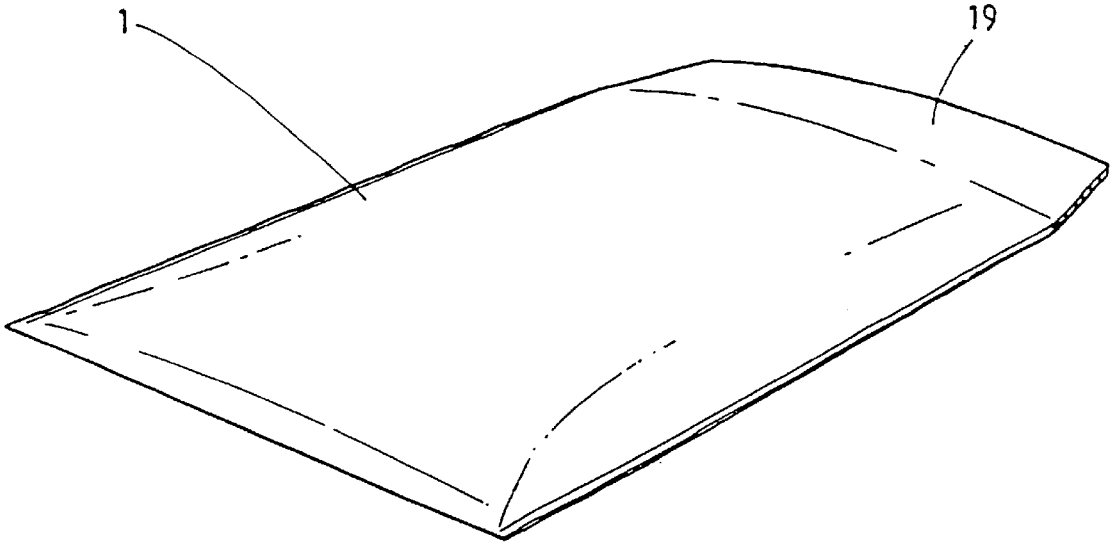
FIG. 2 is a perspective view of the other side of the envelope as shown in FIG. 1.
Figure 1:
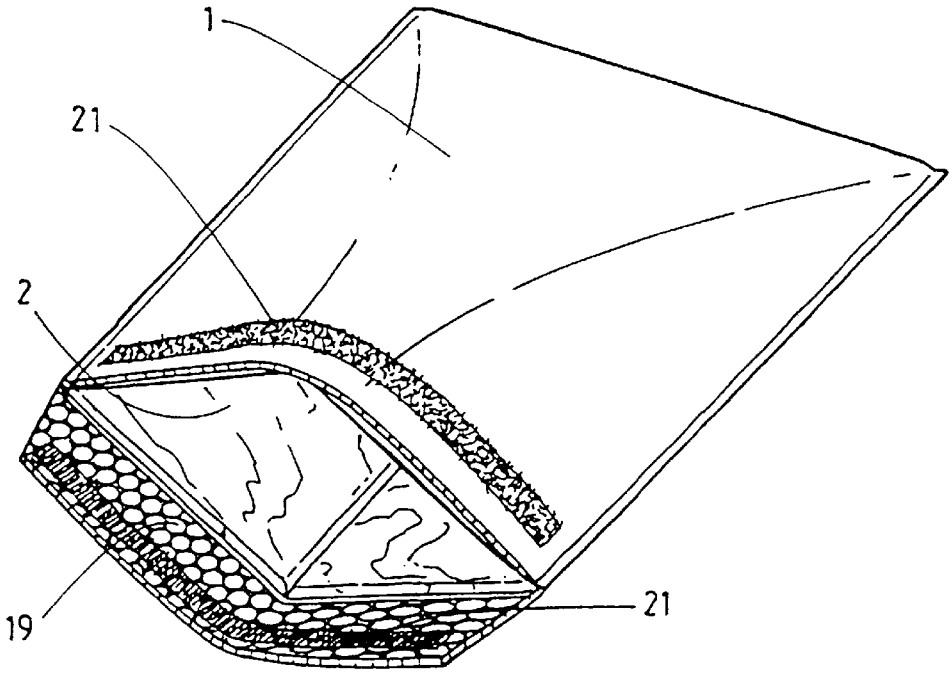
FIG. 1 is a perspective view of an envelope according to the embodiment.
Figure 3:
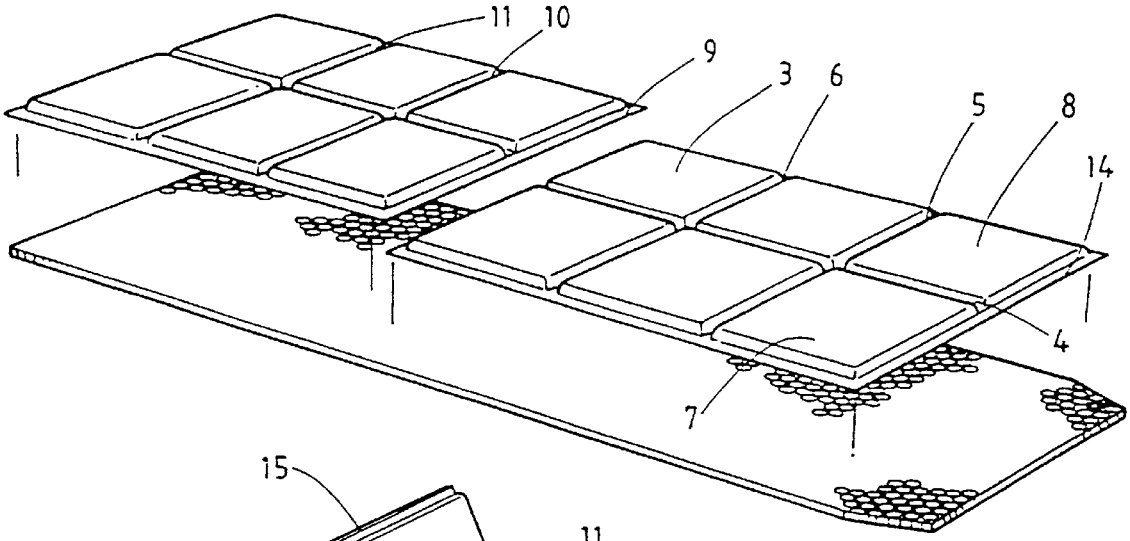
FIG. 3 is a separated and exploded view of parts of the envelope as shown in FIGS. 1 and 2.

Accordingly, an inner envelope shape is made by sheets of plastic having trapped cells of liquid between themselves in which liquid to be frozen is kept. These cells are perhaps best seen in FIG. 3 in which it can be seen that there are a plurality of cells which are divided both longitudinally and laterally so that there is a middle longitudinal division at 4 and two lateral divisions at 5 and 6, each of these being such that whether the liquid in a respective cell such as 7 and 8 is frozen and therefore rigid, from cell to cell, they can bend simply because the plastic between them has excluded any frozen and therefore rigid material and the plastic is implicitly pliable.

This works for both the longitudinal division 4 and the lateral divisions 5 and 6 on the one side and the 9 in the other case and 10 and 11 for the lateral divisions.

The next problem is to provide insulation so that the frozen liquids with enclosed articles can be kept in the cold state for as long as possible during transport.

As the same time there needs to be durability, lightness and economy.

In accord with this, there is used as an outer envelope, a sheet of plastics material which is formed so that there are retained between respective sheets of plastics, bubbles which are in the form of a plurality of side by side cylinder shapes trapping air.

Such material is conventionally used for packing purposes and might be referred to in a conventional manner as a bubble pack. This material is conventionally used because it will provide substantial cushioning with very light weight and low cost.

We have observed however that it can provide good insulation but it has a problem that it is conventionally made from clear plastic. Implicitly therefore it is susceptible to quick heating by radiant heat passing through albeit that it will provide convection insulation.

Figure 10:
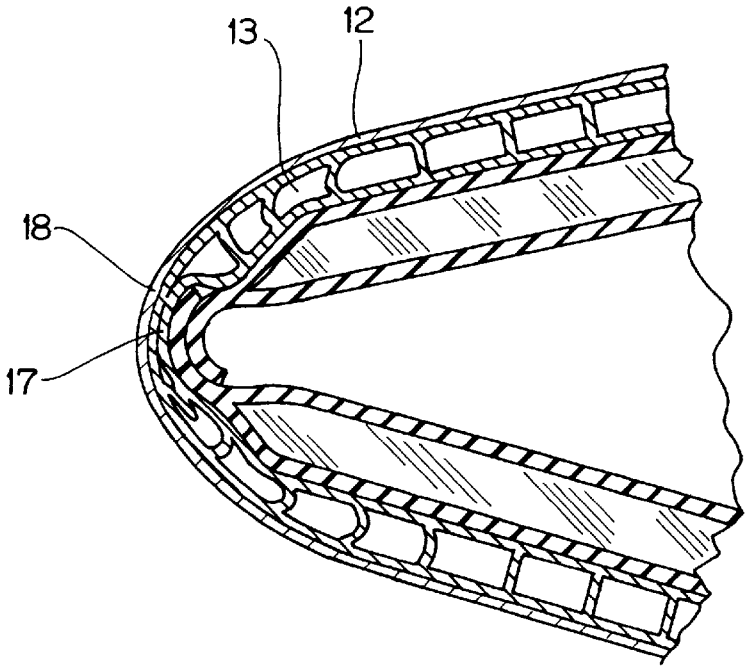
FIG. 10 is a cross-section showing in much more detail the elements forming the inner end of the envelope as shown in the preceding figures.
Figure 11:
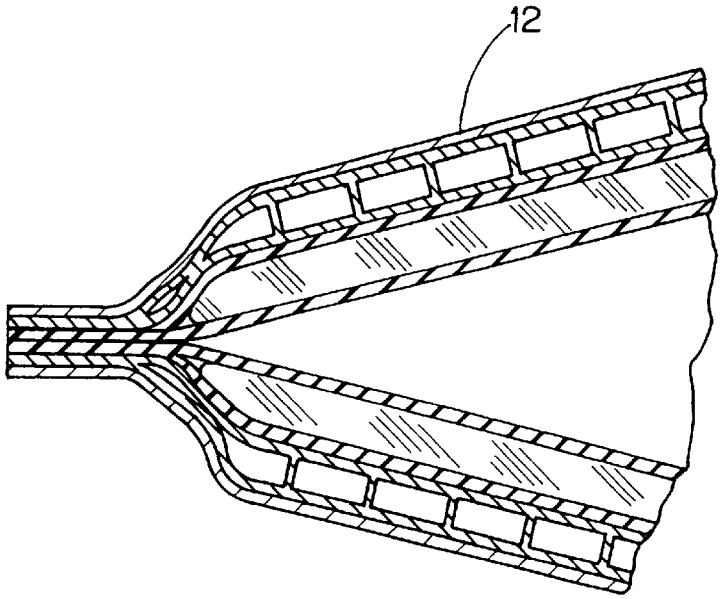
FIG. 11 is a side cross-sectional view again showing all of the elements in much greater detail.
Figure 12:
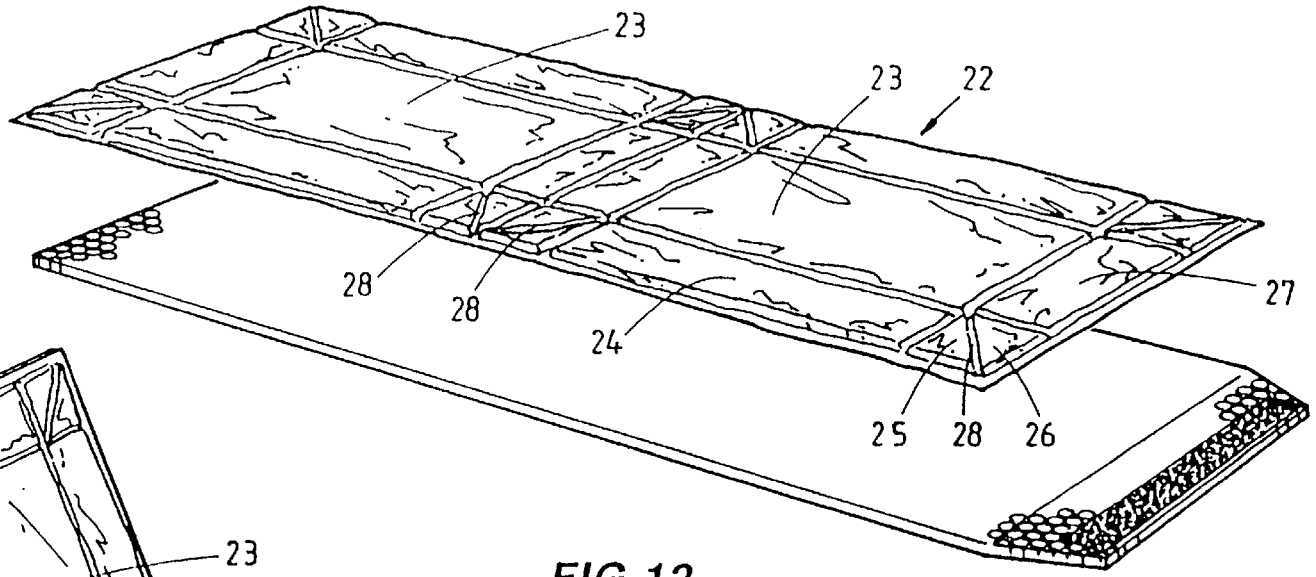
FIG. 12 is an exploded view of a second embodiment.
Figure 13:
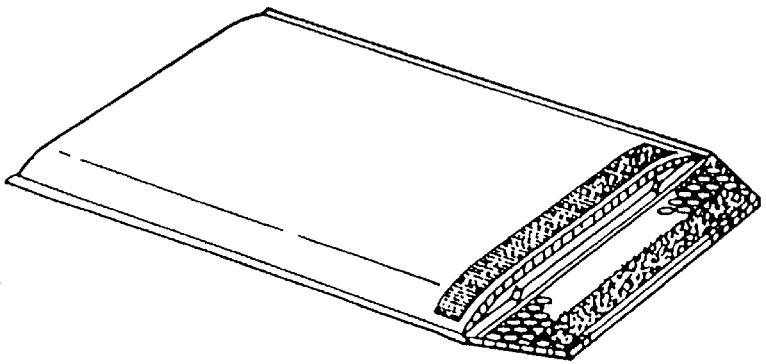
FIG. 13 is the second embodiment in which the inner envelope is now located against the inner face of the outer insulating envelope and the drawing shows the two in an unjoined condition along each side.
Figure 14:
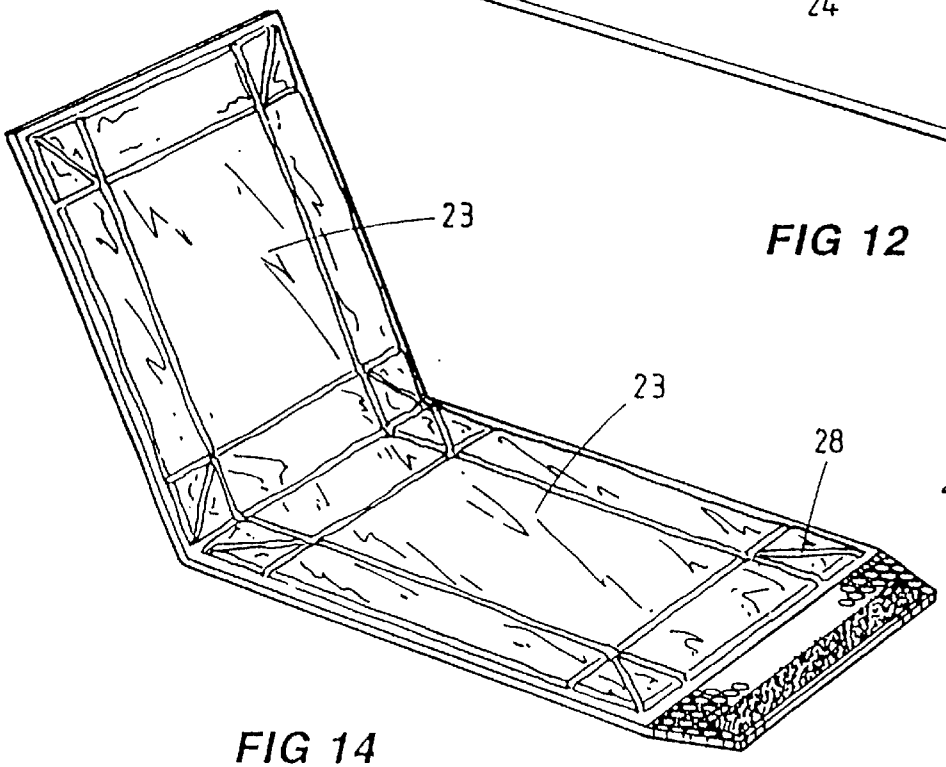
FIG. 14 is the view of the arrangement as in FIG. 13 when it is joined together along the peripheral sides.
Figure 15:
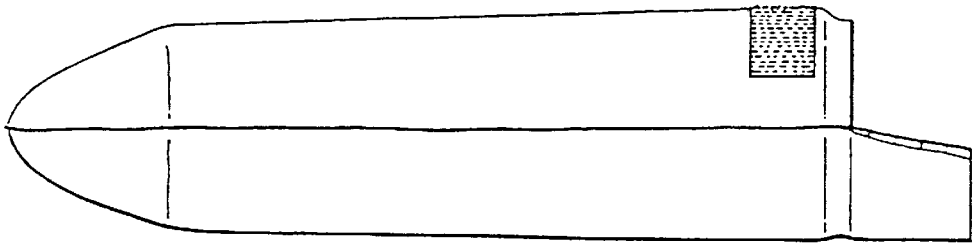
FIG. 15 is a side view of the embodiment as in FIG. 14.
Figure 16:
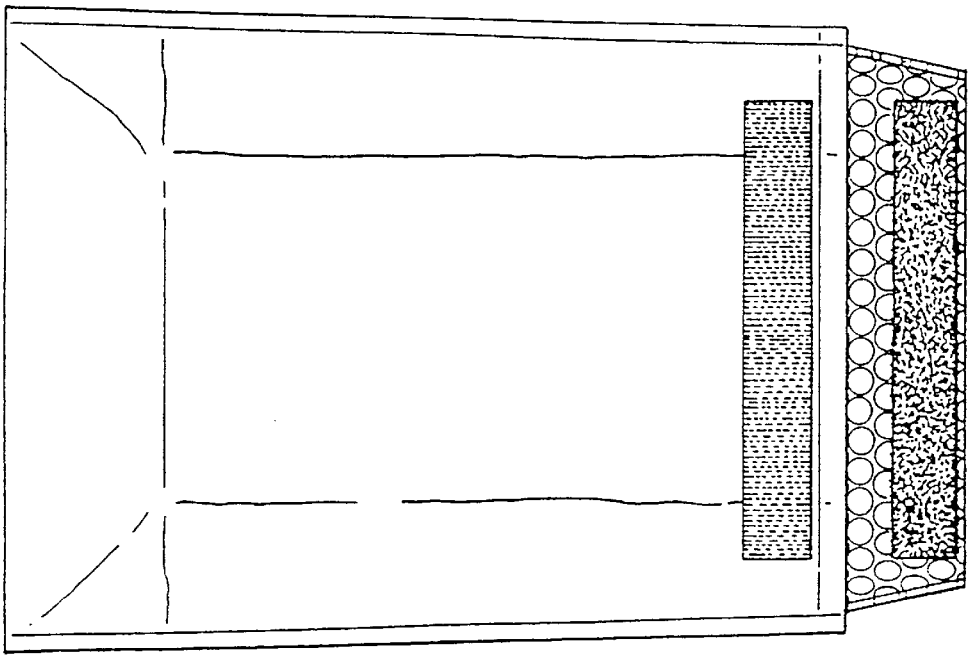
FIG. 16 is a plan view.
Figure 17:
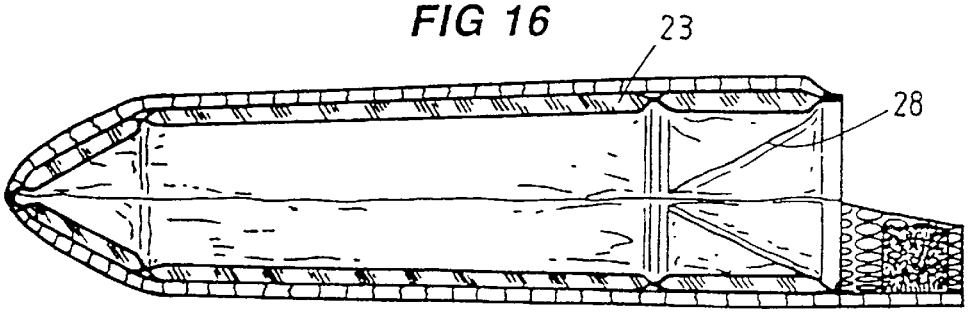
FIG. 17 is a cross-sectional view, partly schematic, showing the envelope in its opened form.
Figure 18:
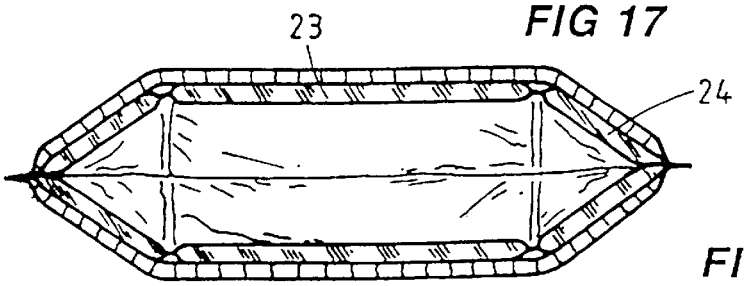
FIG. 18 is a further cross-sectional view.
Figure 19:
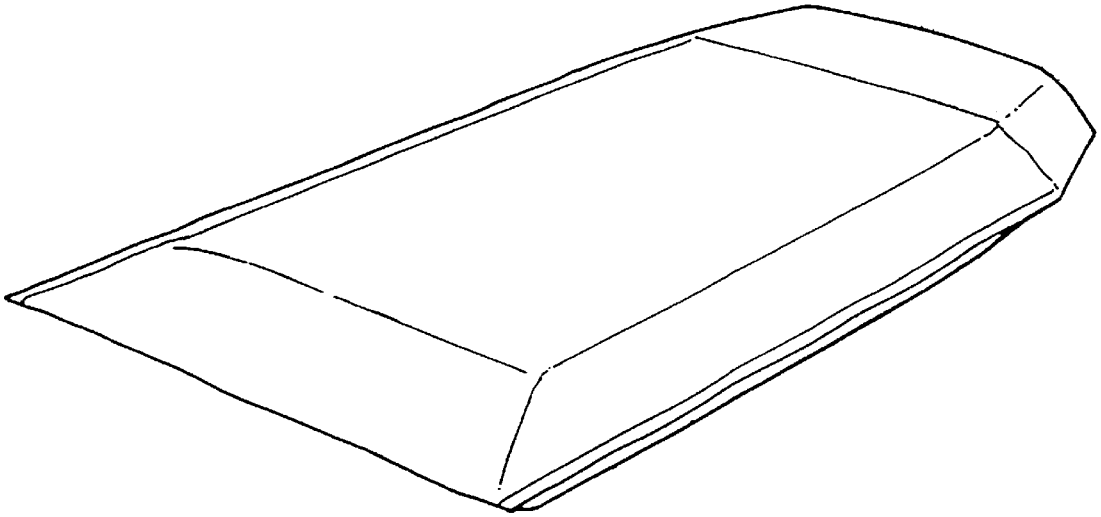
FIGS. 19 and 20 are other perspective views from the external side of the second embodiment.
Figure 20:
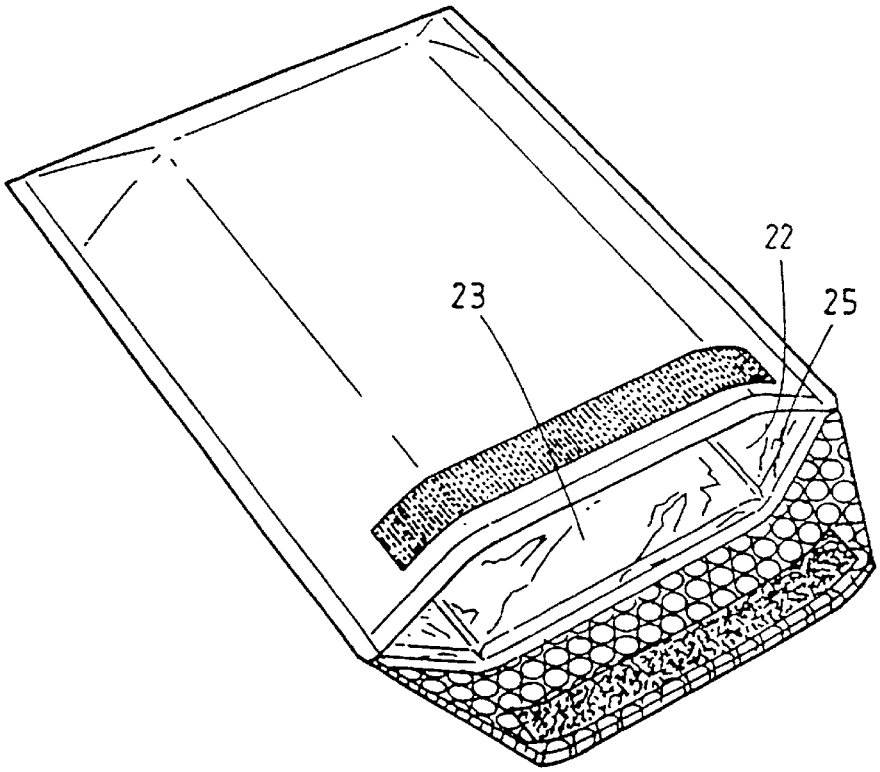

Accordingly, we have provided an external reflective coat shown in FIGS. 10 and 11 as 12, which is secured to an outer side of the plastics bubble material 13.

Such external reflective material 12 should be able to reflect radiant heat and a highly reflective silver coating has been used in the embodiment.

A next problem however has been to ensure that any articles that might be inserted into the now frozen envelope 1 shall be surrounded by the frozen materials and to this extent therefore the forward most edges of the inner envelope material are welded at the mouth of the envelope shape to the outer envelope bubble material so that if the mouth is opened at all, both the inner and outer envelope is opened so that there simply cannot be access to the envelope other than into the central mouth so that any articles then inserted are sure to be located safely between the frozen cells forming the inner envelope.

Figure 4:
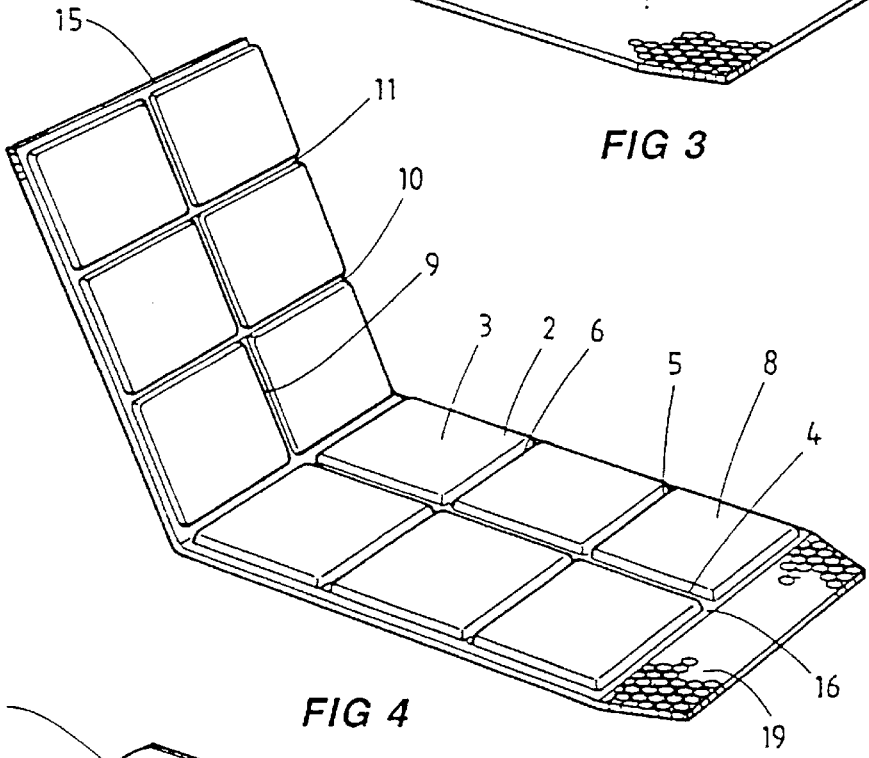
FIG. 4 shows the next stage after FIG. 3 by which the parts making up the inner envelope are now joined to the outer sheet.
Figure 5:
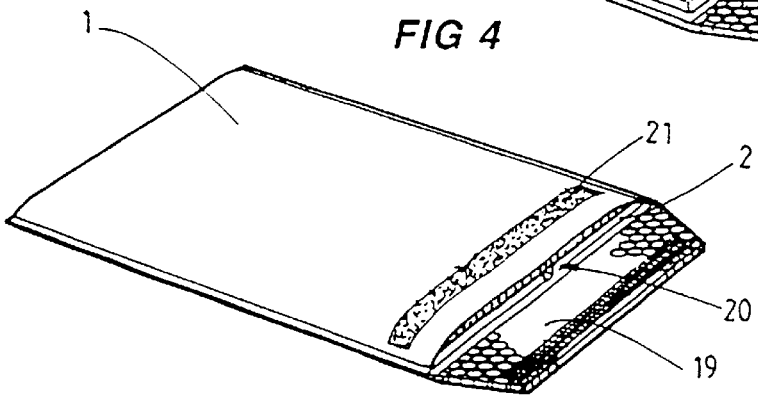
FIG. 5 is the welded together finished product.
Figure 6:
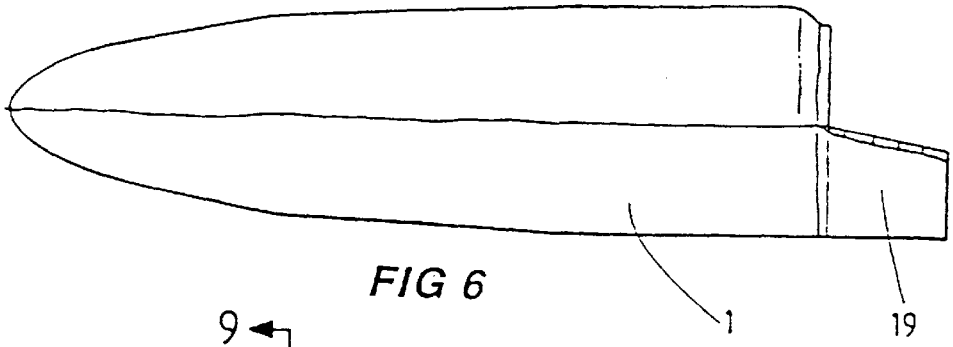
FIG. 6 is a side elevation of the finished product.
Figure 7:
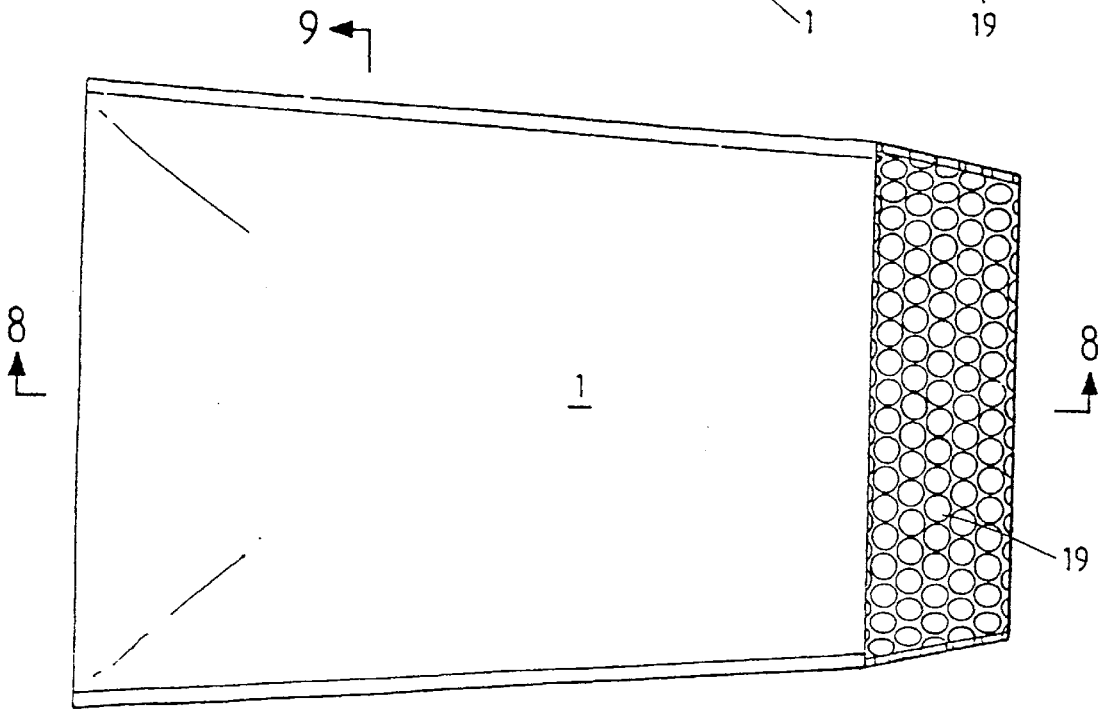
FIG. 7 is a plan view of the product.
Figure 8:
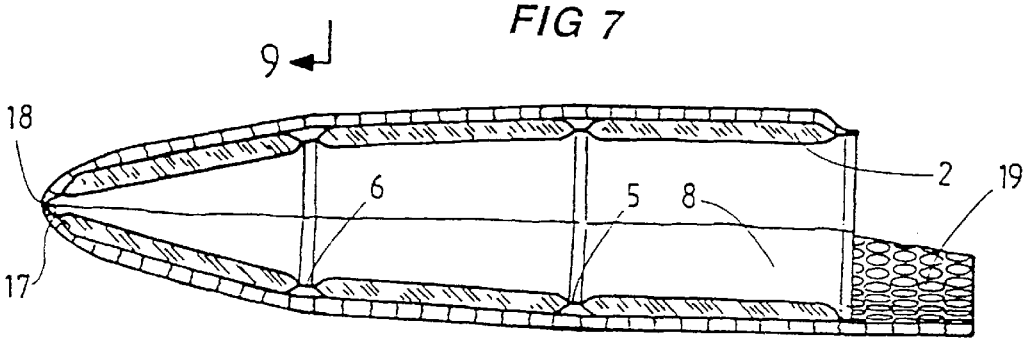
FIG. 8 is a cross-sectional view along the lines 8,8 in FIG. 7.
Figure 9:
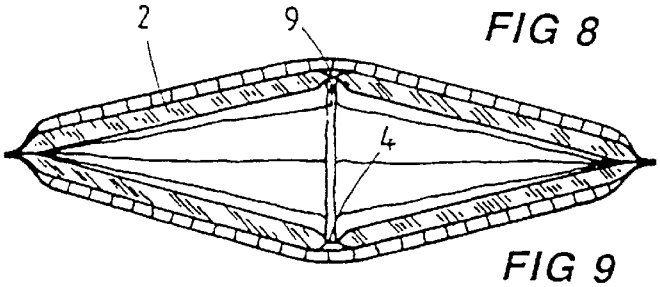
FIG. 9 is a cross-sectional view along the lines 9,9 as shown in FIG. 7.

The inner end of inner envelope shape at 17 is also adhered to the bottom or inner end 18 of the outer envelope so that when the inner envelopes liquid or liquid like materials are not frozen, these nonetheless will be kept spread out so that when they are frozen, they will remain in the essentially planar alignment as shown in FIGS. 4 and 5 of the drawings.

Likewise, the sides are also welded together as shown in FIG. 11 so that we have a composite sandwich joining along the full side of the respective inner and outer envelopes.

Finally, there is a closure flap 19 and this is adapted to be used to close fully around the otherwise open mouth 20 envelope there can in the embodiment be an appropriate adhesion material shown typically at 21 to ensure that the flap 19 will stay in a closed position during transport.

Now referring to the second embodiment shown in FIGS. 12 through 20, the difference here is that the inner envelope shape is achieved by comprising cells have different shapes which facilitates the shape of the overall envelope when it is opened and the cells are frozen.

In particular, the envelope 22 includes a central large cell 23 for each side and side cells shown typically at 24, 25, 26 and 27 and so on where in each case, these are located around the periphery of the centre cell 23 and at the corners are divided by a diagonal join shown typically at 28 so that the joins between the frozen cells will allow for a flexing of these joins and such that the cell shapes, in each case, will facilitate an open shape inside the envelope which is most efficient for holding a package of rectilinear shape.

Figure 21:
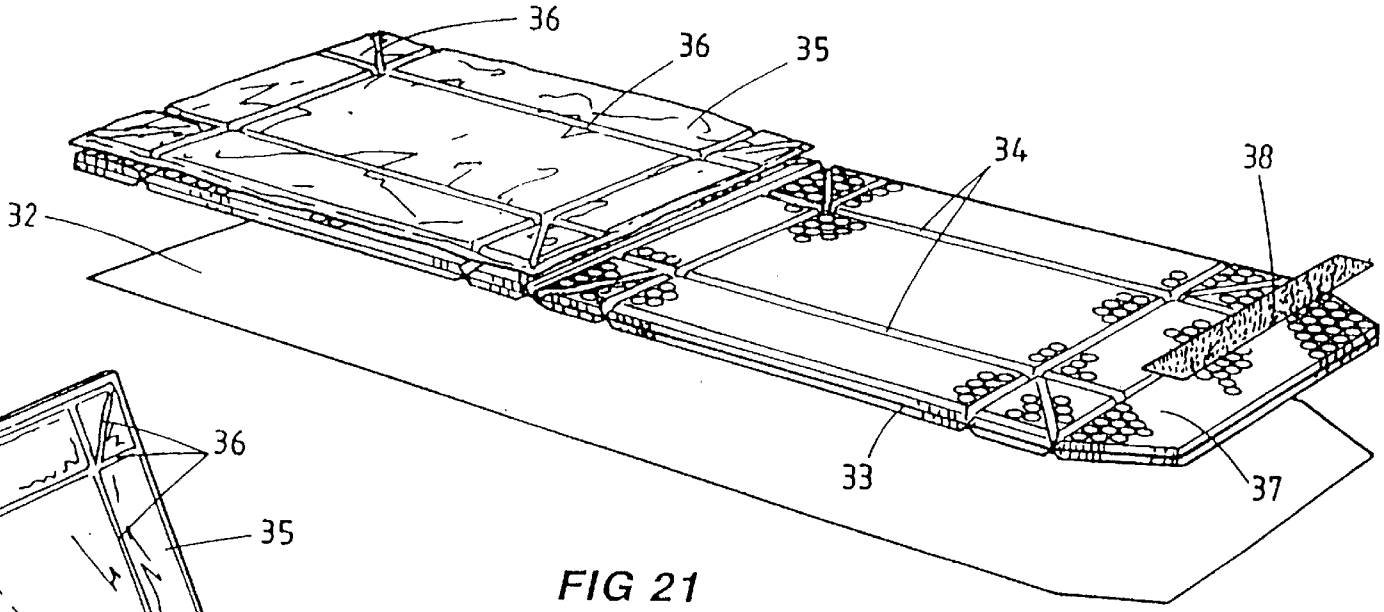
FIG. 21 is a perspective view showing the several parts making up the envelope in accordance with this embodiment.
Figure 23:
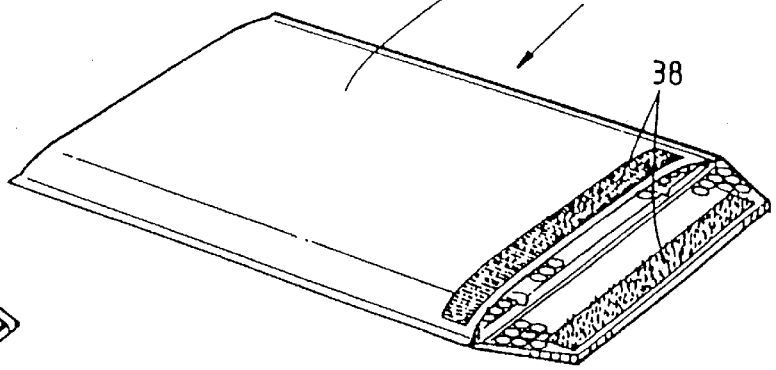
FIG. 23 is a perspective view of the envelope as finally constructed.
Figure 22:
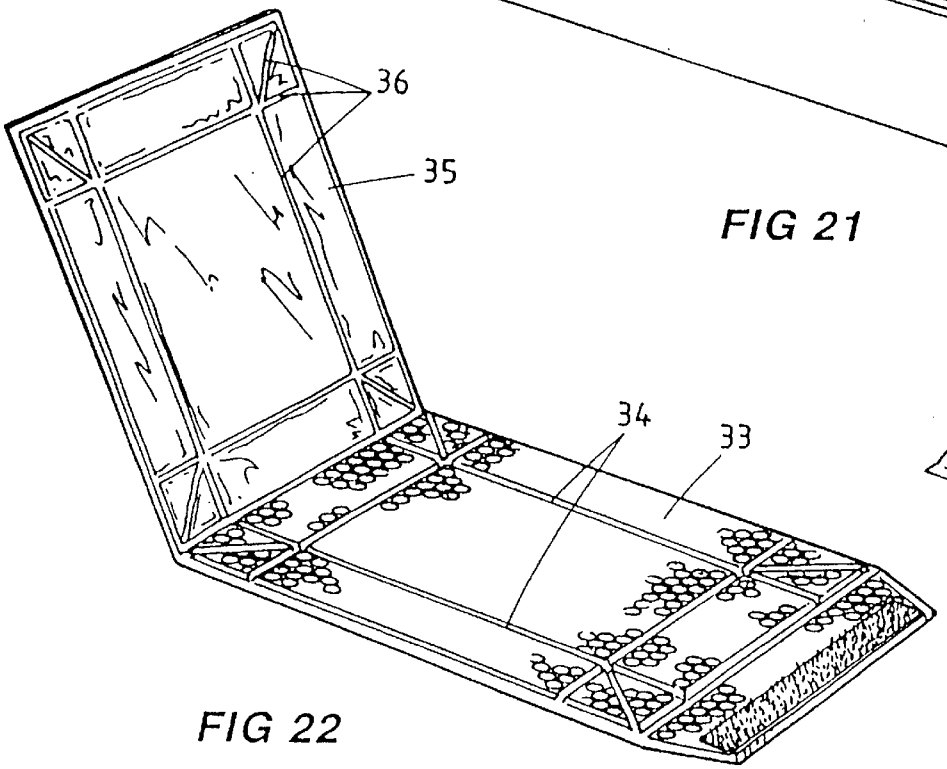
FIG. 22 is a perspective view where the elements have been joined together prior to forming the final envelope shape.

Referring in detail to the drawings in FIGS. 21, 22 and 23, the envelope 31 is constructed of a metallised reflective material providing an outer layer shown at 32 and attached to this is the double layer of plastic bubble material shown at 33 this material being divided by heat seams as shown typically at 34 and finally there is a pouch containing gel at 35, this being divided by heat compressed seams shown typically at 36 which promotes the bending of the material even when the gel is frozen.

The remaining elements are as described in the previous provisionals which include a closure flap at 37 and some means of keeping the closure flap closed such as a velcro strip at 38.

FIG. 22 shows the elements prior to final closure around the perimeter by heat sealing so that there is then formed an envelope shape however between a gel provided in frozen form by the pack 35, and the double layer of bubble pack material at 33.

From what has now been described in relation to an embodiment, it will be seen that there can now be provided safe transport of such articles such as vials of biological materials such as vaccines or medicines that need to be kept at a low temperature during an extended transport period.

The envelope is otherwise economic to manufacture, relatively sturdy as far as long use is concerned and is safe to use for those who might otherwise be inexperienced in dealing with such products.

What is claimed is:

1. A cold keeping envelope for articles that need to be kept cold during transport, comprising:

an outer envelope and an inner envelope having liquid to be frozen held within a plurality of separate cells forming the inner envelope such that when the liquid is frozen solid, the inner envelope can be caused to open by pivotal movement of at least one of said separate cells with respect to at least one other of said separate cells to allow for insertion of articles therein; and wherein said outer envelope includes at least one sheet of a plastic material in a bubble formation.

2. The cold keeping envelope of claim 1, wherein the at least one sheet of plastic material has sides that are welded together to form an envelope shape, thereby forming the outer insulation envelope.

3. The cold keeping envelope of claim 1, further comprising an opaque heat reflective surface on an outer side of the outer envelope material.

4. The cold keeping envelope of claim 1, wherein the at least one of said separate cells is separated from the at least one other of said separate cells by a mutual joint area that does not become rigid by freezing at least at temperatures at which the liquid will be frozen solid.

5. The cold keeping envelope of claim 1, wherein the inner envelope has outer edges that are welded or otherwise adhered to or joined to outer edges of the outer envelope around a mutual opening area.

6. The cold keeping envelope of claim 1, wherein a bottom of the inner envelope is welded to an inner bottom end of the outer envelope.

7. The cold keeping envelope of claim 1, wherein the plurality of separate cells is on only one side of the inner envelope.

8. The cold keeping envelope of claim 1, wherein there is separation of the cells on one side so that each cell can be bent with respect to the other cells when the material contained within the cells is frozen solid.

9. The cold keeping envelope of claim 1, wherein the plurality of separate cells includes a central cell and a plurality of side or perimeter cells adapted to allow for an opening shape in which the side cells will be caused to pivot so that when the cold keeping envelope is in a fully opened position each of the side cells is substantially aligned at right angles to a planar orientation of the central cell.

10. The cold keeping envelope of claim 1, wherein the plurality of separate cells includes diagonally divided cells at each corner of each side of parts of the cold keeping envelope having the separate cells.

11. A cold keeping envelope for articles that need to be kept cold during transport, comprising:

an outer envelope and an inner envelope having liquid to be frozen held within a plurality of separate cells forming the inner envelope such that when the liquid is frozen solid, the inner envelope an be caused to open by pivotal movement of at least one of said separate cells with respect to at least one other of said separate cells to allow for insertion of articles therein; and wherein the cold keeping envelope includes two layers of plastic retaining air in bubble-like formations.

12. The cold keeping envelope of claim 11, wherein the two layers of plastic are heat sealed together.

* * * * *